US012782026B2

(12) United States Patent
Kyriacou et al.

(10) Patent No.: US 12,782,026 B2
(45) Date of Patent: Nov. 3, 2026

(54) ICE MAKER APPLIANCE CONTROL METHODS

(71) Applicant: Haier US Appliance Solutions, Inc., Wilmington, DE (US)

(72) Inventors: Stephanos Kyriacou, Louisville, KY (US); Michael Goodman Schroeder, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 489 days.

(21) Appl. No.: 18/296,731

(22) Filed: Apr. 6, 2023

(65) Prior Publication Data

US 2024/0337424 A1 Oct. 10, 2024

(51) Int. Cl.
*F25C 1/04* (2018.01)

(52) U.S. Cl.
CPC ..... *F25C 1/04* (2013.01); *F25C 2400/10* (2013.01); *F25C 2400/14* (2013.01); *F25C 2700/04* (2013.01)

(58) Field of Classification Search
CPC .... F25C 1/04; F25C 2400/10; F25C 2400/14; F25C 2700/04
See application file for complete search history.

(56) References Cited

U.S. PATENT DOCUMENTS

| | | | | |
|---|---|---|---|---|
| 6,334,318 | B1 | 1/2002 | Ando et al. | |
| 6,526,763 | B2 | 3/2003 | Tchougounov et al. | |
| 7,100,379 | B2 | 9/2006 | Son et al. | |
| 7,131,280 | B2 | 11/2006 | Voglewede et al. | |
| 7,216,491 | B2 | 5/2007 | Cole et al. | |
| 7,555,909 | B2 | 7/2009 | Chang | |
| 11,391,510 | B2 | 7/2022 | Jung et al. | |
| 2006/0242971 | A1* | 11/2006 | Cole | F25C 1/04 62/340 |
| 2023/0243565 | A1* | 8/2023 | Kim | F25C 1/04 62/139 |

FOREIGN PATENT DOCUMENTS

| | | | |
|---|---|---|---|
| JP | H04187959 | A | 7/1992 |
| KR | 100756993 | B1 | 9/2007 |

* cited by examiner

*Primary Examiner* — Elizabeth J Martin
(74) *Attorney, Agent, or Firm* — Dority & Manning, P.A.

(57) ABSTRACT

A method of operating an ice maker appliance includes flowing a volume of liquid water into a mold body of the ice maker appliance and forming an ice piece from the volume of liquid water in the mold body of the ice maker appliance. The method also includes estimating a volume of the fill of liquid water. The method may include determining an adjustment factor based on the estimated volume of the fill of liquid water or determining a harvest time based on the estimated volume of the fill of liquid water.

15 Claims, 9 Drawing Sheets

ICE MAKER APPLIANCE CONTROL METHODS

FIELD OF THE INVENTION

The present subject matter relates generally to ice maker appliances, and in particular to systems and methods for controlling such appliances.

BACKGROUND OF THE INVENTION

Certain refrigerator appliances include an ice maker. An ice maker appliance may also be a stand-alone appliance designed for use in commercial and/or residential settings. To produce ice, liquid water is directed to the ice maker and frozen. For example, certain ice makers include a mold body for receiving liquid water. After the mold body is filed with liquid water, the mold body and liquid water therein are cooled to freeze the liquid water and thereby form ice. After ice is formed in the mold body, it may be harvested from the mold body and stored within an ice bin or bucket within the ice maker appliance.

The liquid water that is flowed to the mold body may vary from one cycle to the next, such as a temperature of the liquid water may vary or the volume of liquid water provided may vary. System conditions such as water pressure upstream of the ice maker, valve wear or valve orifices, and overall system fluid resistance may also vary, e.g., from cycle to cycle or among different units of the same ice maker, and may result in variations in the volume of liquid water provided to the different cycles or different units. Such variations may result in inconsistent ice making performance, such as undesirable variations in the size, shape, or quantity of ice produced. Additionally, ice maker control parameters which are designed for the most extreme possible scenarios, e.g., highest incoming water temperature or largest fill volume, may be excessive for the actual conditions of a given fill and harvest cycle, such that the conservative control parameters may result in excessive freezing time which may delay the overall ice maker operations, e.g., may delay the beginning of the next cycle.

Accordingly, an ice maker appliance with features for effectively managing water fill volume or temperature would be desirable. For example, an ice maker appliance with features for evaluating and responding to one or both of water fill volume or temperature would be desirable.

BRIEF DESCRIPTION OF THE INVENTION

Aspects and advantages of the invention will be set forth in part in the following description, or may be apparent from the description, or may be learned through practice of the invention.

According to an exemplary embodiment, a method of operating an ice maker appliance is provided. The method includes flowing a first fill of liquid water into a mold body of the ice maker appliance and forming an ice piece from the first fill of liquid water in the mold body of the ice maker appliance. The method also includes estimating a volume of the first fill of liquid water and determining an adjustment factor based on the estimated volume of the first fill of liquid water. The method further includes harvesting the ice piece from the mold body after forming the ice piece from the first fill. The method also includes flowing a second fill of liquid water into the mold body after harvesting the ice piece. The second fill of liquid water is based on the adjustment factor.

According to another exemplary embodiment, a method of operating an ice maker appliance is provided. The method includes flowing a fill of liquid water into a mold body of the ice maker appliance and forming an ice piece from the fill of liquid water in the mold body of the ice maker appliance. The method also includes estimating a volume of the fill of liquid water and determining a harvest time based on the estimated volume of the first of liquid water. The method further includes harvesting the ice piece from the mold body at the harvest time after the step of forming.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
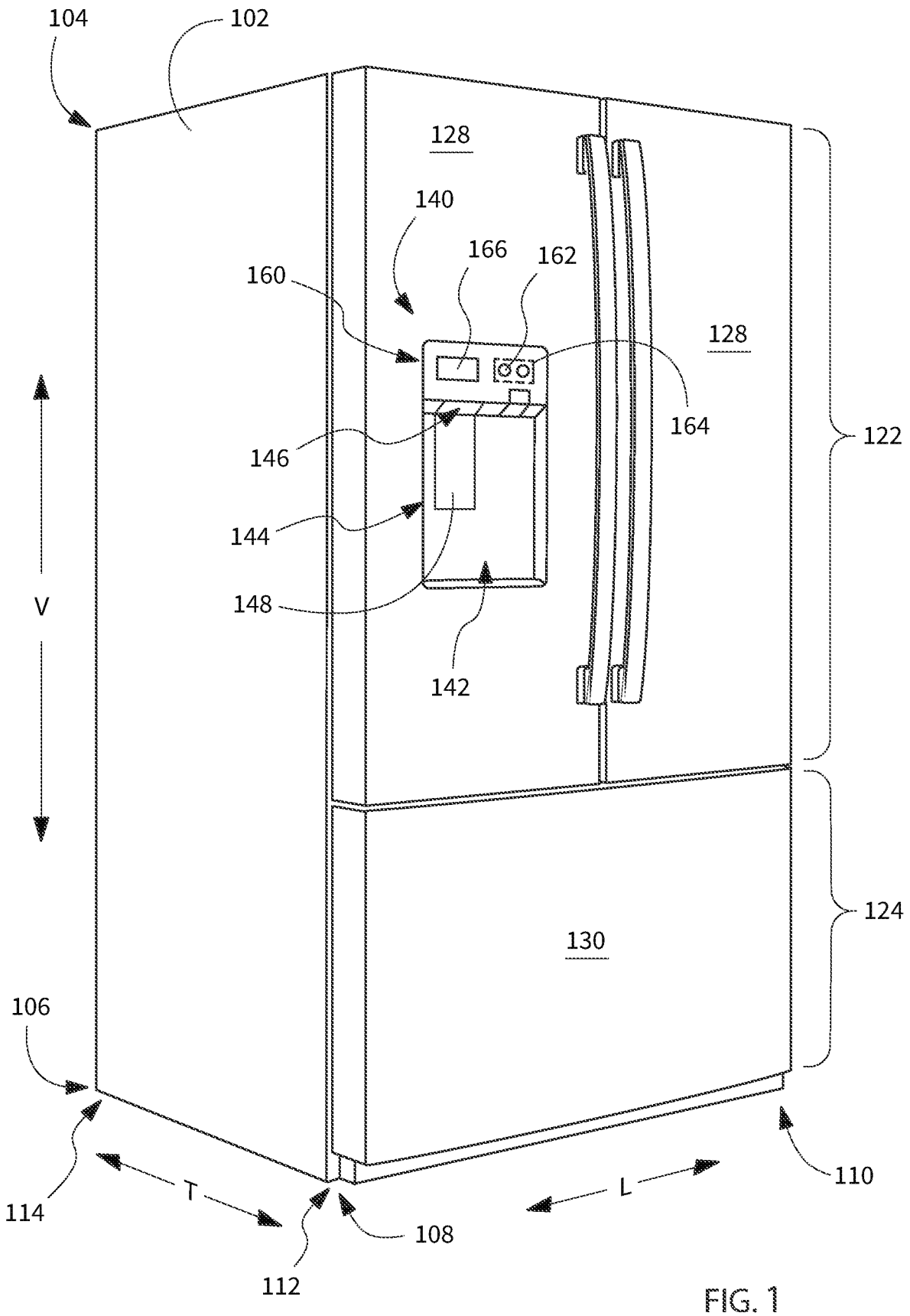
FIG. 1 provides a perspective view of a refrigerator appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment.

Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise. As used herein, the terms "first," "second," and "third" may be used interchangeably to distinguish one component from another and are not intended to signify location or importance of the individual components.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
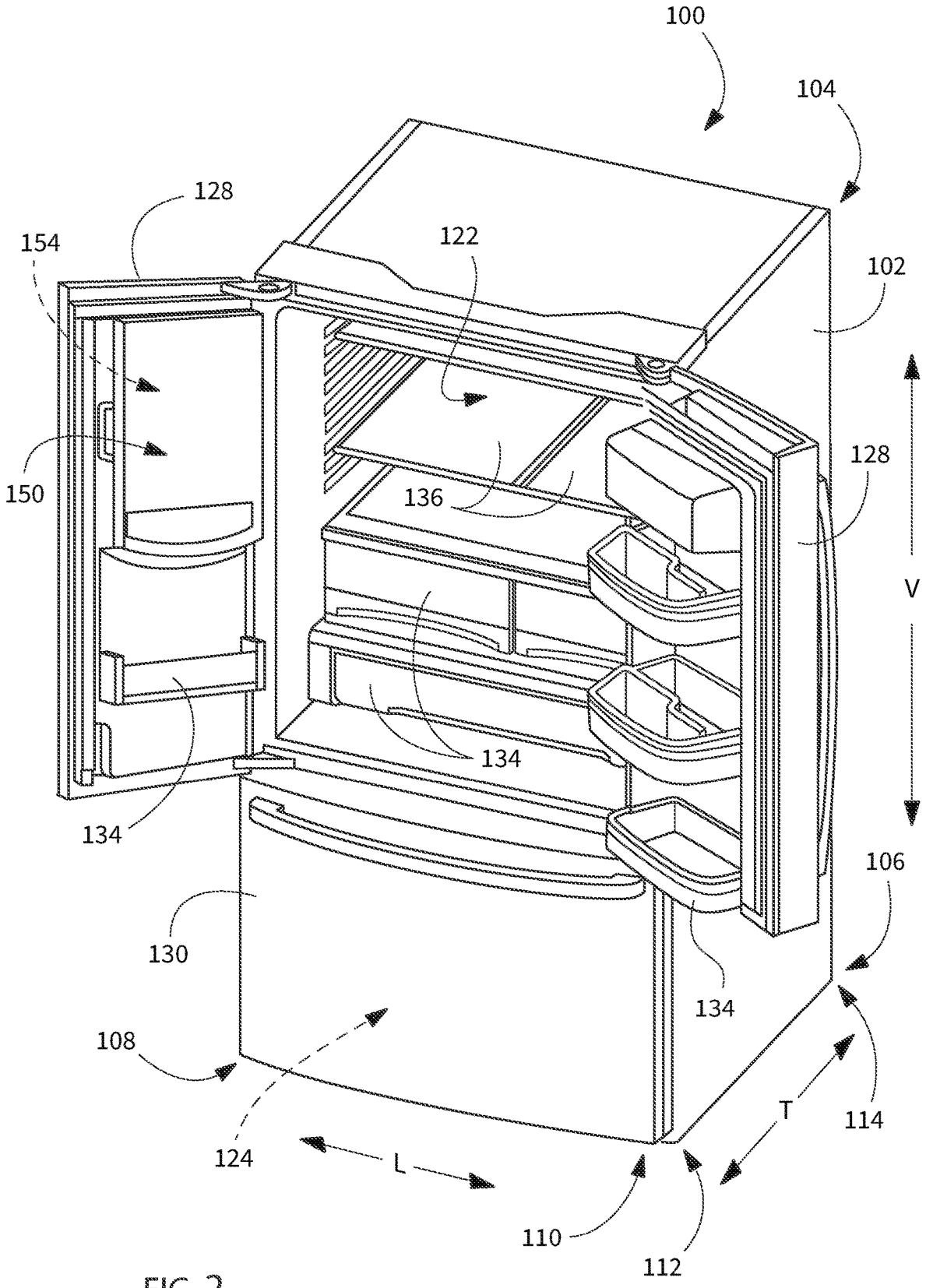
FIG. 2 provides a perspective view of the exemplary refrigerator appliance of FIG. 1, with the doors of the fresh food chamber shown in an open position.

FIGS. 1 and 2 provide perspective views of a refrigerator appliance 100 according to an exemplary embodiment of the present subject matter. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items, etc.) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2 through 4) housing an ice making assembly which includes a mold body 200 (see also FIG. 5) and an ice storage bin 220 that are configured to supply ice to dispenser recess 142. In this regard, for example, icebox 150 may define an ice making chamber 154 for housing an ice making assembly, a storage mechanism, and a dispensing mechanism. The ice making assembly is described in further detail below with reference to FIG. 5.

A control panel 160 is provided for controlling the mode of operation. For example, control panel 160 includes one or more selector inputs 162, such as knobs, buttons, touch-screen interfaces, etc., such as a water dispensing button and an ice-dispensing button, for selecting a desired mode of operation such as crushed or non-crushed ice. In addition, inputs 162 may be used to specify a fill volume or method of operating dispensing assembly 140. In this regard, inputs 162 may be in communication with a processing device or controller 164. Signals generated in controller 164 operate refrigerator appliance 100 and dispensing assembly 140 in response to selector inputs 162. Additionally, a display 166, such as an indicator light or a screen, may be provided on control panel 160. Display 166 may be in communication with controller 164, and may display information in response to signals from controller 164.

As used herein, "processing device" or "controller" may refer to one or more microprocessors or semiconductor devices and is not restricted necessarily to a single element. The processing device can be programmed to operate refrigerator appliance 100 and dispensing assembly 140. The processing device may include, or be associated with, one or more memory elements (e.g., non-transitory storage media). In some such embodiments, the memory elements include electrically erasable, programmable read only memory (EEPROM). Generally, the memory elements can store information accessible to the processing device, including instructions that can be executed by processing device. Optionally, the instructions can be software or any set of instructions and/or data that when executed by the processing device, cause the processing device to perform operations.

Figure 3:
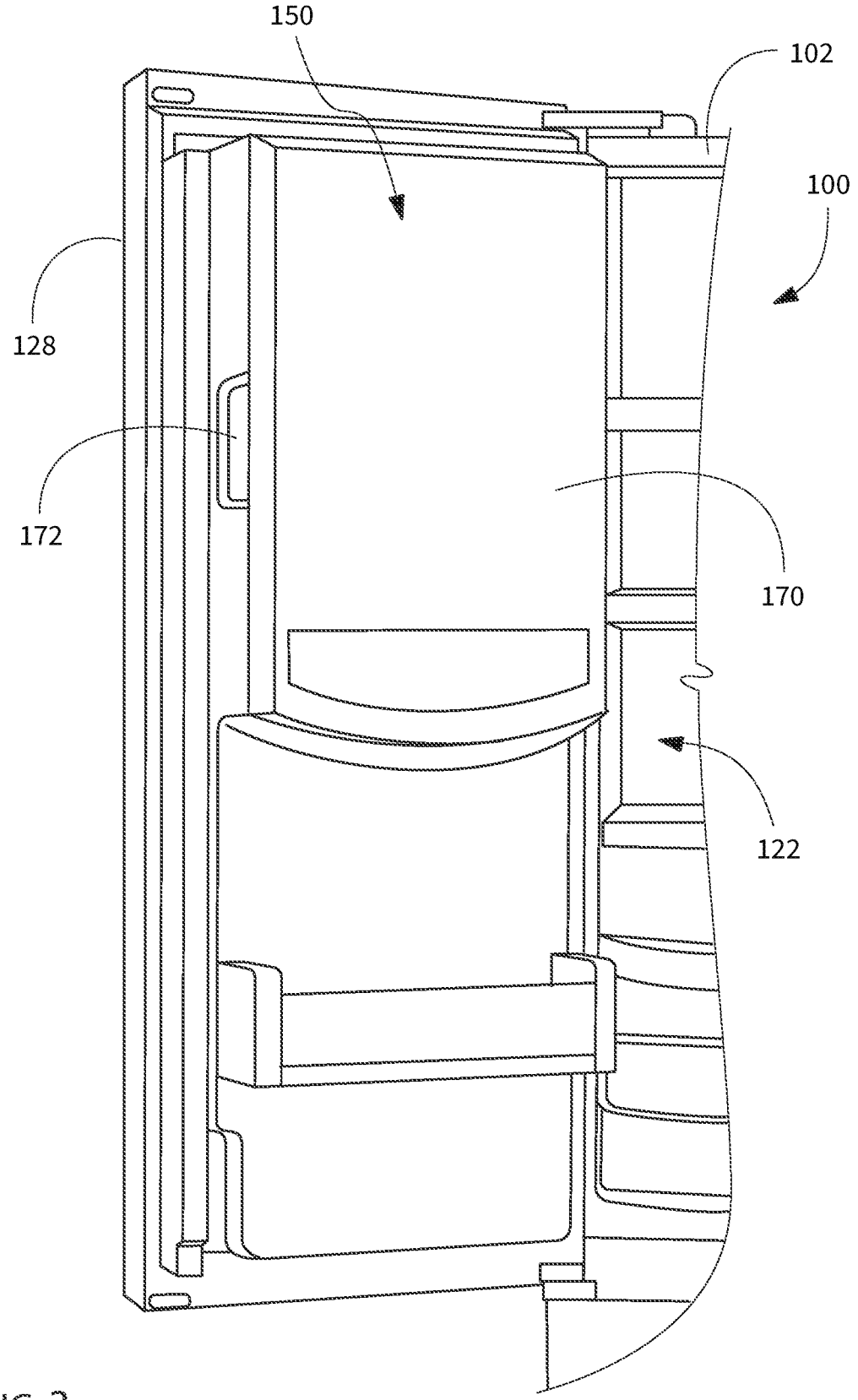
FIG. 3 provides an interior perspective view of a dispenser door of the exemplary refrigerator appliance of FIG. 1.
Figure 4:
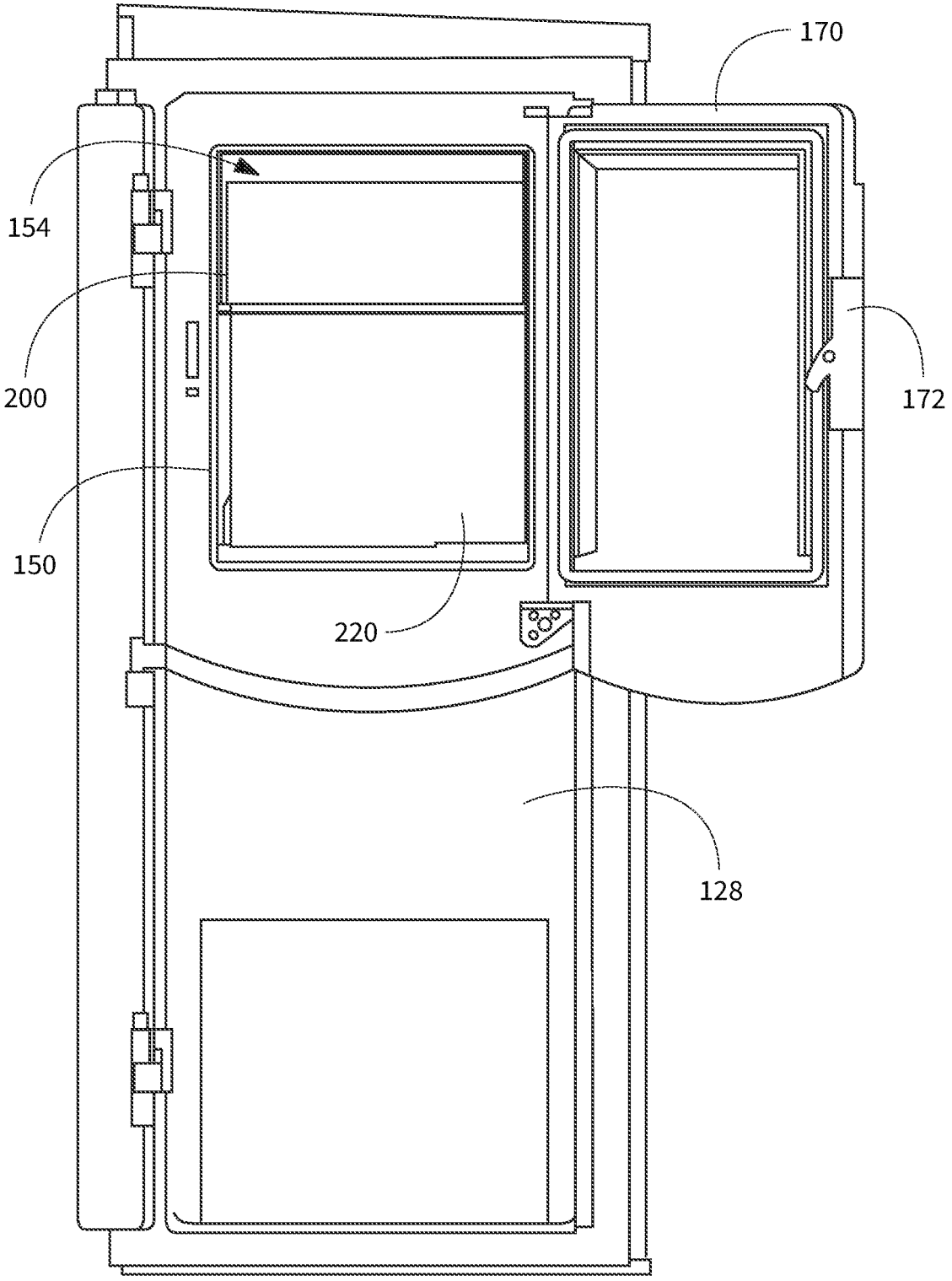
FIG. 4 provides an interior elevation view of the door of FIG. 3 with an access door of the door shown in an open position.

Referring now to FIGS. 3 and 4, FIG. 3 provides an interior perspective view of one of the refrigerator doors 128 and FIG. 4 provides an interior elevation view of the door 128 with an access door 170 shown in an open position. Refrigerator appliance 100 includes a sub-compartment 150 defined on refrigerator door 128. As mentioned above, the sub-compartment 150 may be referred to as an "icebox." In the illustrated exemplary embodiment, icebox 150 extends into fresh food chamber 122 when refrigerator door 128 is in the closed position. The general position of the mold body 200, e.g., relative to the icebox 150 and storage bin 220, is illustrated in FIG. 4, and further details of the ice making assembly, including the mold body 200 thereof, are provided below in reference to FIG. 5. As shown in FIG. 4, the mold body 200 may be positioned within the icebox 150. The mold body 200 is generally configured for freezing the water to form ice, e.g., ice pieces such as ice cubes, which may be stored in storage bin 220 and dispensed through discharging outlet 146 by dispensing assembly 140. For example, the mold body 200 may include one or more mold cavities defined therein, and liquid water may be directed into the mold cavity or cavities of the mold body 200 and the water may then be retained therein at a temperature at or below the freezing point of water to form an ice piece or ice pieces. FIG. 4 illustrates the mold body 200 with an ice storage bin 220 positioned below the mold body 200 for receiving ice pieces from the mold body 200, e.g., for receiving the ice after the ice is ejected from the mold body 200. As those of ordinary skill in the art will recognize, ice from the mold body 200 is collected and stored in the ice storage bin 220 and supplied to dispenser 144 (FIG. 1) from the ice storage bin 220 in icebox 150 on a back side of refrigerator door 128. Chilled air from a sealed system (not shown) of refrigerator appliance 100 may be directed into or onto components within the icebox 150, e.g., mold body 200 and/or ice storage bin 220.

As mentioned above, the present disclosure may also be applied to other types and styles of refrigerator appliances such as, e.g., a top mount refrigerator appliance, a side-by-side style refrigerator appliance or a standalone ice maker appliance. Variations and modifications may be made to ice making assembly while remaining within the scope of the present subject matter. Accordingly, the description herein of the icebox 150 on the door 128 of the fresh food chamber 122 is by way of example only. In other example embodiments, the ice making assembly may be positioned in the freezer chamber 124, e.g., of the illustrated bottom-mount refrigerator, of a side by side refrigerator, of a top-mount refrigerator, or any other suitable refrigerator appliance. As another example, the ice making assembly may also be provided in a standalone ice maker appliance. As used herein, the term "standalone ice maker appliance" refers to an appliance of which the sole or primary operation is generating or producing ice, e.g., without any additional or other chilled chambers other than the icebox, whereas the more general term "ice maker appliance" includes such appliances as well as appliances with diverse capabilities in addition to making ice, such as a refrigerator appliance equipped with an ice maker, among other possible examples.

As mentioned above, an access door 170 may be hinged to the inside of the refrigerator door 128. Access door 170 permits selective access to icebox 150. Any manner of suitable latch 172 may be configured with icebox 150 to maintain access door 170 in a closed position. As an example, latch 172 may be actuated by a consumer in order to open access door 170 for providing access into icebox 150. Access door 170 can also assist with insulating icebox 150, e.g., by thermally isolating or insulating icebox 150 from fresh food chamber 122.

Figure 5:
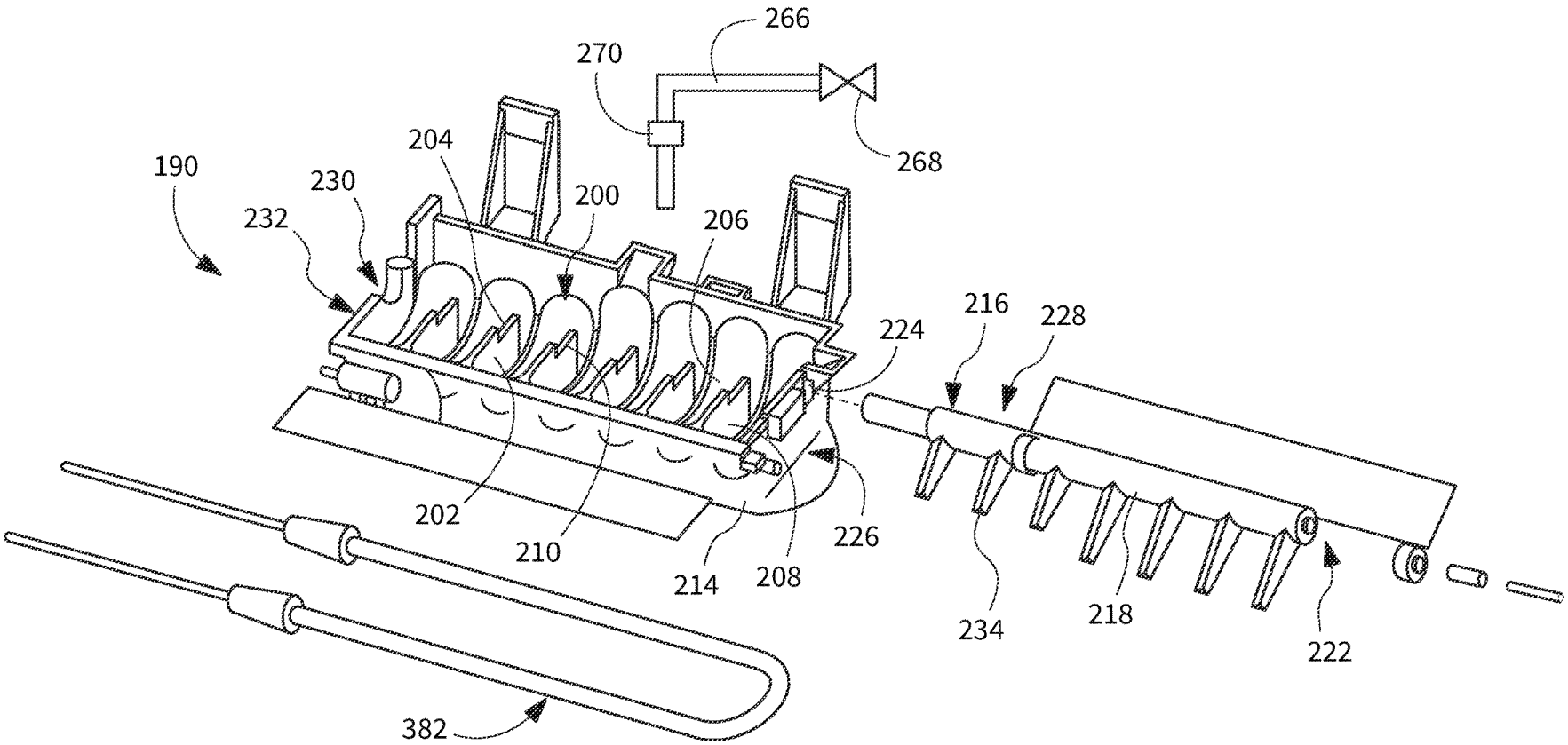
FIG. 5 provides an exploded perspective view of an ice making assembly in accordance with one or more embodiments of the present disclosure.

As illustrated in FIG. 5, an ice making assembly in accordance with one or more embodiments of the present disclosure may include a body or ice tray 190 including mold body 200 for receiving water and freezing the water therein to form ice. As shown, the ice tray 190 includes seven substantially identical ice forming compartments, e.g., cavities in the mold body 200, although it should be appreciated that more or less than seven ice forming compartments can be provided. It should also be appreciated that while one exemplary type of ice maker is illustrated (e.g., which may sometimes be referred to as a crescent cube variety of ice maker), any suitable ice maker including a twist tray type, can be utilized in connection with the present disclosure. In the illustrated embodiment, each compartment of mold body 200 includes an arcuate bottom surface 206. Also as may be seen in FIG. 5, each compartment is divided by a partition wall 208 and each partition wall 208 includes a first side surface 202 and a second side surface 204 opposite the first side surface 202. The partition walls 208 extend transversely across the ice tray 190 to divide the ice forming compartments in which ice pieces (not shown) are formed, e.g., whereby fourteen ice pieces may be formed collectively in the seven compartments. Each partition wall 208 includes a recessed upper edge portion 210 through which water flows successively through each compartment of mold body 200 to fill the ice tray 190 with water. A water filling operation of ice tray 190 may be carried out according to one or more exemplary embodiments as described in further detail below.

Water is provided to compartments of mold body 200 through a channel or water distribution manifold 266, e.g., by opening a water valve 268 coupled in-line to the water distribution manifold 266. In some embodiments, the ice making assembly may include a flow meter 270 coupled to the water distribution manifold 266 for measuring a flow rate of the liquid water supplied to the mold body 200 via the water distribution manifold 266 (water distribution manifold 266, water valve 268, and flow meter 270 are schematically illustrated in FIG. 5). The water distribution manifold may include one or more outlets. Liquid water can flow from the water distribution manifold of outlets thereof to introduce water to the compartments of mold body 200. Such liquid water is chilled to or below the freezing temperature of water such that liquid water flowing within compartments of mold body 200 can freeze and form ice pieces.

As shown in FIG. 5, the ice making assembly may include a sheathed electrical resistance heating element or ice harvest heater 382 which may be mounted to a lower portion 214 of the ice tray 190. The heater can be press-fit, stacked, and/or clamped into lower portion 214 of ice tray 190. Ice harvest heater 382 is configured to heat mold body 200 when a harvest cycle is executed to slightly melt the ice and release the ice from the compartments of mold body 200.

A rake or ice ejector 216 is rotatably connected to ice tray 190. Ice ejector 216 includes an axle or shaft 218 and a plurality of ejector members located in a common plane, e.g., extending radially from or tangent to axle 218, such as one ejector member for each compartment of mold body 200 or each ice piece formed therein. Axle 218 is concentric about the longitudinal axis of rotation of ice ejector 216. To rotatably mount ice ejector 216 to ice tray 190, a first end section 222 of ice ejector 216 is positioned adjacent an opening 224 located at a first end portion 226 of ice tray 190. A second end section 228 of ice ejector 216 is positioned in an arcuate recess 230 located on a second end portion 232 of ice tray 190. In the illustrated embodiment, ejector members are triangular shaped projections 234 and are configured to extend from axle 218 into the compartments of mold body 200 when ice ejector 216 is rotated. It is within the scope of the present disclosure for ejector members 234 to be fingers, shafts, or other structures extending radially beyond the outer walls of axle 218. Ice ejector 216 is rotatable relative to ice tray 190 from a closed first position to a second ice harvesting position and back to the closed position. Rotation of ice ejector 216 causes ejector members 234 to advance into the compartments of mold body 200 whereby ice located in each compartment is urged in an ejection path of movement out of the ice forming compartment.

Figure 6:
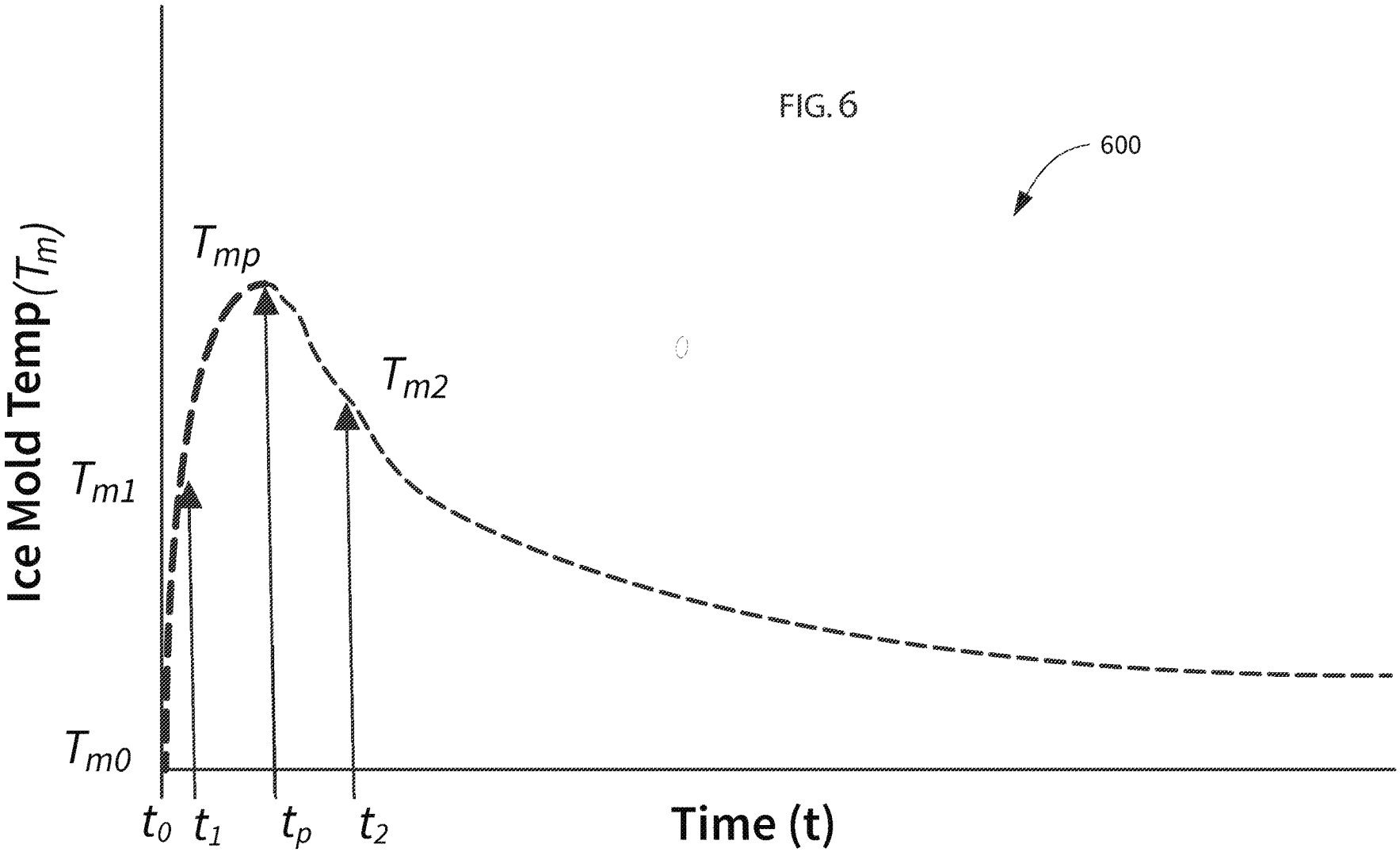
FIG. 6 provides an exemplary graph of temperatures of an ice maker appliance over time.

Turning now to FIG. 6, an exemplary graph 600 of mold body temperatures ($T_m$) over time (t) in an ice maker appliance is provided. In particular, graph 600 represents an exemplary mold body temperature during a fill and subsequent ice formation period. The fill of the mold body with liquid water begins at time $t_0$. As may be seen in FIG. 6, the introduction of relatively warm liquid water (e.g., warmer than the mold body, such as were the liquid water is above the freezing point of water and the mold body is generally at or below the freezing point of water) raises the temperature of the mold body from an initial mold body temperature $T_{m0}$ to a peak temperature or equilibrium temperature $T_{mp}$ beginning at time $t_0$ until time $t_0$ peak $t_p$. The temperature $T_{mp}$ may be an equilibrium temperature in that the liquid water temperature and the mold body temperature are approximately equal at this point in time (e.g., at time to peak $t_p$). The change in temperature may be measured over some or all of the time period from time $t_0$ until time to peak $t_p$, such as from time $t_0$ at the beginning of the fill to a first time point $t_1$ which is between the time $t_0$ and the time to peak $t_p$, and at which time the corresponding mold body temperature is $T_{m1}$.

After reaching the peak temperature or equilibrium temperature, the mold body temperature gradually decreases, e.g., as compared to the relatively rapid rise in temperature induced by the fill of liquid water into the mold body, as the liquid water and the mold body are cooled, e.g., by chilled air provided to the ice maker assembly, such as from a freezer evaporator or fresh food evaporator of a refrigerator appliance or other suitable chilled air source. The temperature change may also or instead be measured over a time period beginning at the peak temperature $T_{mp}$, e.g., from the time to peak $t_p$ to a subsequent time such as second time $t_2$, where the mold body temperature at second time $t_2$ is $T_{m2}$. The mold body may be at a second temperature $T_{m2}$ at the second time $t_2$, and the second temperature $T_{m2}$ may be greater than the freezing point of water, e.g., greater than 32° F. Thus, the time period beginning at the peak temperature $T_{mp}$ over which the temperature change may be measured may be less than the total ice formation time, e.g., before the ice pieces are harvested from the mold body, such as before phase change (freezing) begins.

The rate of temperature change, e.g., rise, from time $t_0$ to time $t_1$, may be used to estimate the fill amount, e.g., the volume of water provided to the mold body during the fill. For example, the mold body temperature as a function of time may follow an exponential step change function. One example of such function is:

$$T_m(t) = T_{FZ} + (T_{m0} - T_{FZ}) \exp\left(-t/\tau_C\right)$$

Where:

$T_m(t)$ is mold body temperature at time t;

$T_{FZ}$ is an ambient temperature, e.g., an air temperature of air at or around the mold body;

$T_{m0}$ is the mold body temperature at time t=0, e.g., at the beginning of the fill; and $\tau_C$ is a time constant.

The ambient temperature $T_{FZ}$ may be, for example, a freezer temperature, an icebox temperature, a temperature measured at the freezer evaporator, or a temperature measured at the fresh food evaporator, or combinations thereof. For example, multiple ambient temperatures may be combined by averaging the multiple ambient temperatures, such as by taking a weighted average of any two or more of the foregoing example ambient temperatures.

The derivative of the above function may represent the rate of change, e.g., slope, of the mold body temperature over time. The rate of change may be inversely proportional to the volume of liquid water in the mold body, e.g., the temperature will change more quickly for a smaller volume of liquid water and more slowly for a larger volume of liquid water. For example, the derivative at time t=0 is:

$$dT_m/dt\ (t = 0) = -(T_{m0} - T_{FZ})/\tau_C$$

The mold body temperature may be directly measured, e.g., with a temperature sensor such as a thermocouple mounted to or otherwise in direct contact with the mold body. By monitoring the mold body temperature over time, such as continuously or periodically directly measuring the mold body temperature throughout a period of time, the rate of change of the mold body temperature may be determined and used to solve the derivative for the time constant $\tau_C$. The time constant may be equal to the thermal mass (mC) divided by a system constant (UA) which represents the heat transfer rate, e.g., $$\tau_C = mC/UA$$

The heat transfer rate (UA) may be empirically determined, e.g., may be a measurable system constant. Thus, after solving the derivative for the time constant ($\tau_C$), the known value of UA may be used to determine the thermal mass (mC), and the volume of liquid water from the fill may be estimated based on the thermal mass, such as the thermal mass may be used to determine a control target, e.g., by backing out the thermal mass of the mold body (which is generally constant from one fill and harvest cycle to the next) to more precisely estimate the volume of liquid water, or by setting the control target to include both the thermal mass of the liquid water and the thermal mass of the mold body. Thus, embodiments of the present disclosure may include smart ice maker appliances or smart methods of operating ice maker appliances which are responsive to errors or deviations in the fill of liquid water, e.g., the control target may generally correct or reduce such deviations or may adapt operations of the ice maker appliance responsive to such deviations. The control target may be, for example, a correction factor for the volume of liquid water from the fill. The correction factor may be applied to a subsequent fill of liquid water, such as the volume of liquid water provided in the subsequent fill may be adjusted based on the correction factor. The control target may also or instead be, for example, a harvest count or harvest time.

For example, the volume of liquid water from the fill may be estimated based on the thermal mass of the water ($(mC)_w$), which may be determined using an equation such as, e.g., for the rate of temperature change from time t=0 to time t=1 ($t_0$ to $t_1$):

$$(mC)_w = [dt_1(T_{m0} - T_{FZ})(UA)_1]/(T_{m0} - T_{m1})$$

The same equations are valid when the mold temperature rises to match the incoming water temperature, e.g., until the mold body reaches the equilibrium temperature or peak temperature, and from after the peak temperature, such as immediately after the peak temperature, e.g., at the first negative slope value, until the phase change begins (e.g., one example time period after the peak temperature is from time $t_p$ to time $t_2$ in FIG. 6). Thus, the measured rate of temperature change used to solve for the time constant and/or thermal mass may be measured during the temperature rise at and after the initial fill of the mold body with liquid water (e.g., from time $t_0$ to time $t_1$, as described above) or the measured rate of change of temperature used to solve for the time constant and/or thermal mass may be measured beginning at the peak temperature (e.g., from time $t_p$ to time $t_2$, using the same equations as described above). In some embodiments, the rate of temperature change may be measured over multiple time periods and the resultant thermal masses or water volumes may be combined, e.g., averaged, such as a weighted average.

The thermal mass of the liquid water ($(mC)_w$) obtained from the above equation may be compared to a predetermined target thermal mass (mC) value for water, and the correction factor may be determined from such comparison, e.g., the correction factor may be set to reduce the difference between the determined thermal mass ($(mC)_w$) and the predetermined target thermal mass (mC). For example, the correction factor may be used to vary the volume of liquid water provided in the subsequent fill, such as by changing the open time for a water supply valve during the subsequent fill.

As another example, the correction factor may be used to adjust a harvest count for the current fill and harvest cycle, such as a reduced harvest count (holding the water in the mold body for a shorter period of time) for a lower estimated volume of liquid water (or lower estimated thermal mass) or an increased harvest count for a larger estimated volume of liquid water or higher estimated thermal mass. The harvest count may be, for example, a count of the time the mold body temperature is below freezing (e.g., is below 32° F.), and may also account for how far below freezing the mold body temperature is, such as by taking an integral, e.g., the area between the freezing point of water and the mold body temperature over time curve, such as the area below the freezing point of water and above the mold body temperature over time curve, such that the measured harvest count increases based on how long and how far the mold body temperature is below freezing. The ice pieces may be harvested when the measured harvest count reached a harvest count threshold, and the harvest count threshold may be based on the estimated volume of the liquid water.

Figure 7:
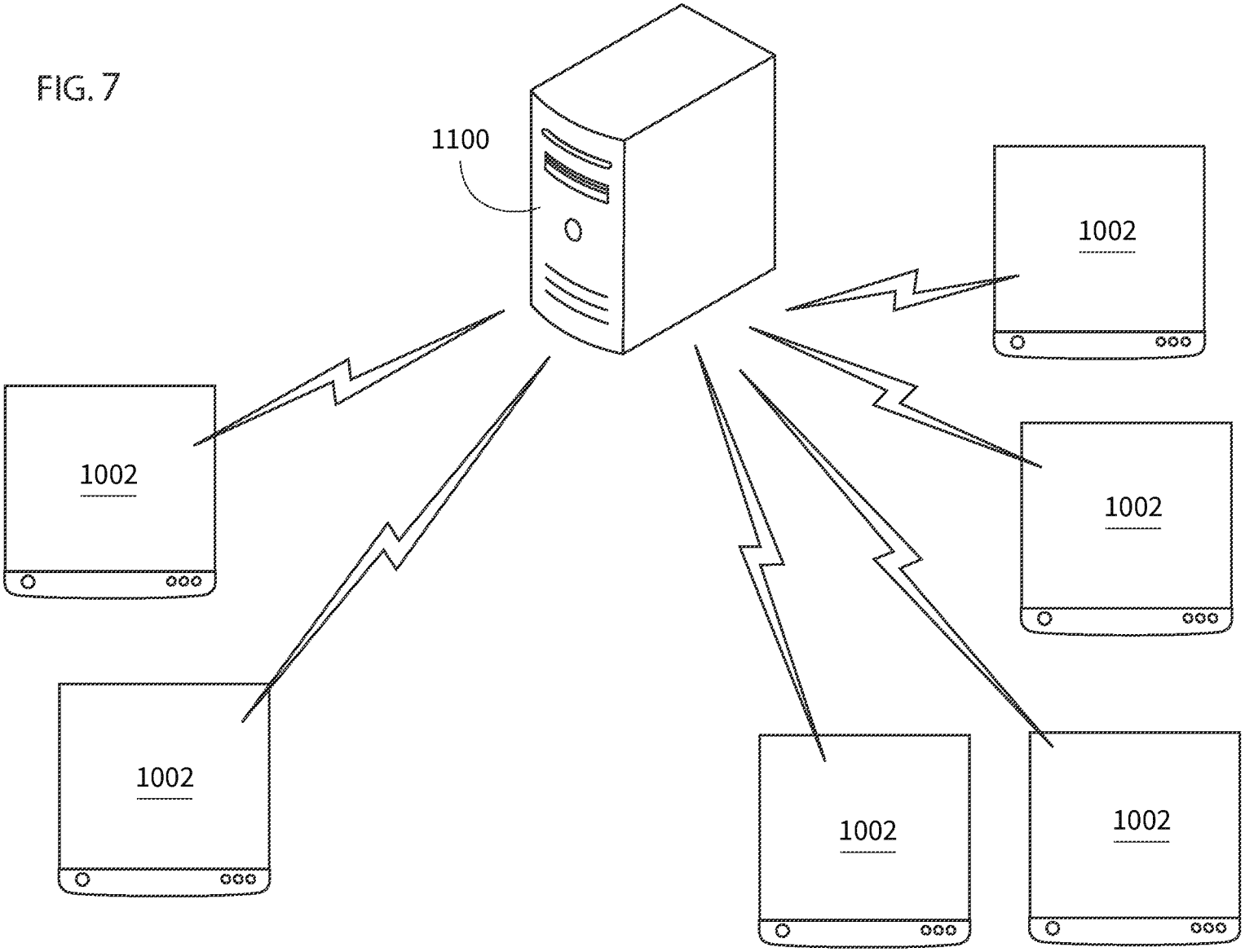
FIG. 7 provides a schematic diagram of multiple ice maker appliances in communication with each other via a remote database.

In some embodiments, the ice maker appliance may be operable and configured to communicate with one or more other ice maker appliances. For example, as illustrated in FIG. 7, a group of ice maker appliances 1002 may be configured and operable to communicate with each other, as well as with a remote database, e.g., remote database 1100 as illustrated in FIG. 7. For example, the ice maker appliances 1002 may communicate with each other via the remote database 1100. FIG. 7 provides a general schematic of the group of ice maker appliances 1002, each of which may be, e.g., an ice maker appliance as described above, and communication features thereof. Each ice maker appliance 1002 may include an antenna (not shown) by which the ice maker appliance 1002 communicates with, e.g., sends and receives signals to and from, one or more other ice maker appliances and the remote database 1100. For example, each appliance of the plurality of ice maker appliances may include a controller, such as the example controller 164 described above, and a wireless communication module connected to the controller or incorporated therein, and, e.g., the antenna may be a component of the wireless communication module. The remote database 1100 may be, e.g., a cloud-based data storage system or other distributed computing system, e.g., in the fog or the edge. For example, the ice maker appliances 1002 may communicate with the remote database 1100 over the Internet, which each ice maker appliance 1002 may access via WI-FI®, and the ice maker appliances 1002 may communicate with each other directly or via the remote database 1100. As mentioned, the controller 164 may include one or more memory devices. The memory devices may also store data that can be retrieved, manipulated, created, or stored by the one or more processors or portions of controller 164. The data can include, for instance, data to facilitate performance of methods described herein. The data can be stored locally (e.g., on controller 164) in one or more remote databases (e.g., in the cloud, fog, edge, or other distributed computing environment, as mentioned above) and/or may be split up so that the data is stored in multiple locations. In addition, or alternatively, the one or more database(s) can be connected to controller 164 of each ice maker appliance through any suitable network(s), such as through a high bandwidth local area network (LAN) or wide area network (WAN). In this regard, for example, controller 164 may further include a communication module or interface that may be used to communicate with one or more other component(s) of the ice maker appliance, controller 164 thereof, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Some of the ice maker appliances 1002 may include a flow meter, e.g., which may measure an actual fill rate during the fill of liquid water or each fill of liquid water, whereas other ice maker appliances 1002 may not include a flow meter. In such cases, the flow meter units may have a more precise system constant (UA) than the non-flow meter units. By inputting system variables for a given ice maker appliance into a function, such as a fit equation, a system constant for the ice maker appliance may be determined. In some embodiments, the system variables for one or more flow meter units out of the plurality of ice maker appliances may be uploaded to the cloud, e.g., remote database 1100, along with the system constant (value of UA) for the one or more flow meter units. In such embodiments, an ice maker appliance which does not include a flow meter, e.g., a non-flow meter unit, may upload system variables for the non-flow meter unit to the cloud and, using the fit equation, the cloud may return a more precise system constant value for the non-flow meter unit, such as a system constant derived from one or more flow meter units having a similar configuration as the non-flow meter unit, e.g., as represented by the system variables and the similarity determined or quantified based on the fit equation.

Figure 8:
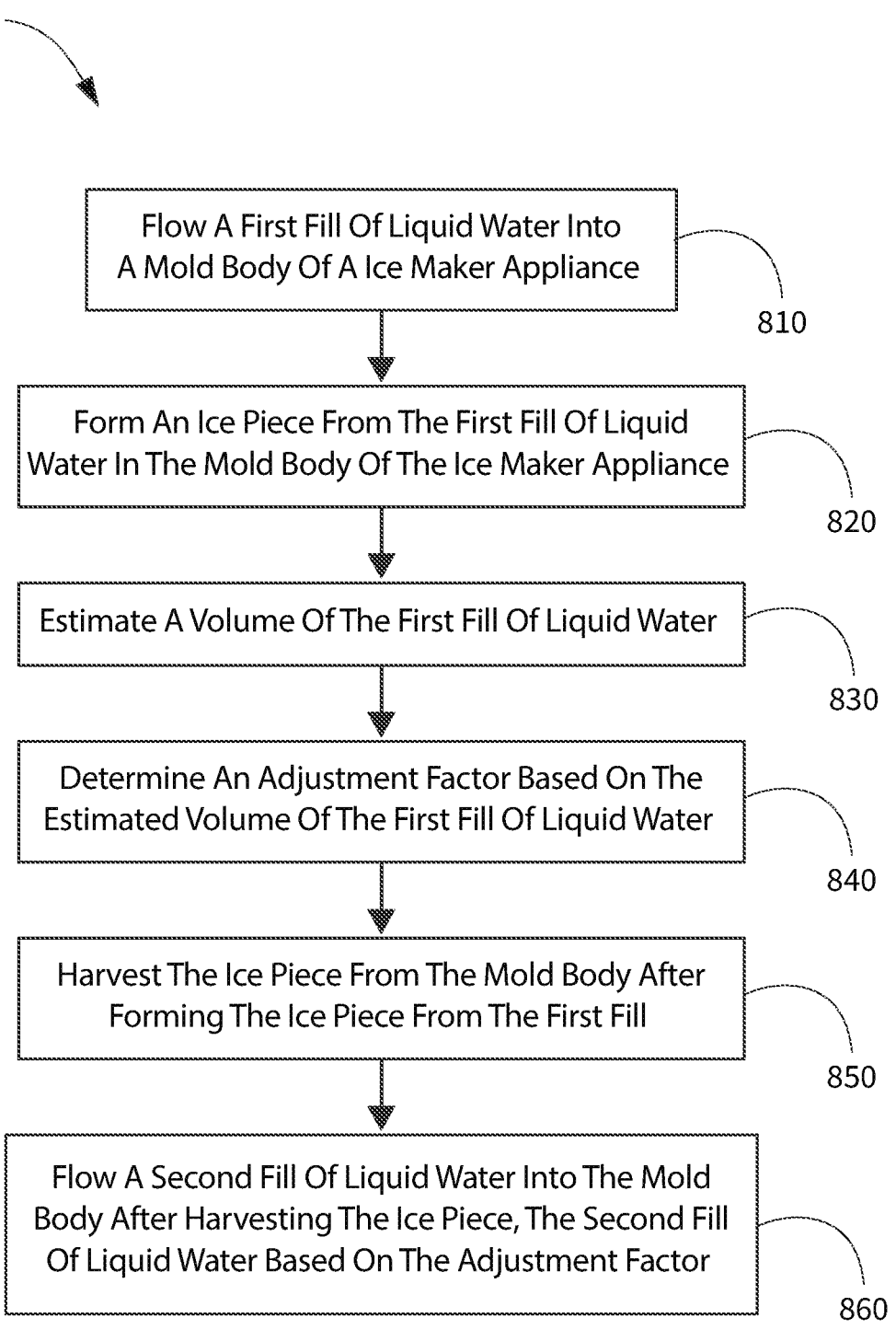
FIG. 8 provides an exemplary flow chart of a method of operating an ice maker appliance according to one or more exemplary embodiments of the present disclosure.

Turning now to FIG. 8, embodiments of the present disclosure also include methods of operating an ice maker appliance, such as the exemplary method 800 illustrated in FIG. 8. As illustrated in FIG. 8, the method 800 may include a step 810 of flowing a first fill of liquid water into a mold body of the ice maker appliance and a step 820 of forming an ice piece from the first fill of liquid water in the mold body of the ice maker appliance, e.g., the liquid water may be retained within the mold body and cooled to or below the freezing point of water until approximately all of the water is frozen to form one or more ice pieces in the ice maker appliance.

Method 800 may also include a step 830 of estimating a volume of the first fill of liquid water. The volume of the first fill of liquid water may be estimated based on one or more temperatures in the ice maker appliance, such as a rate of change of temperature. For example, the rate of change of temperature may be a rate of temperature change due to flowing the first fill of liquid water into the mold body, e.g., beginning at time $t_0$ in FIG. 6, such as from time $t_0$ to time $t_1$ in FIG. 6. In some embodiments, the rate of temperature change due to flowing the first fill of liquid water into the mold body may be a rate of increase in temperature of the mold body induced by the first fill of liquid water. As another example, the volume of the first fill of liquid water may be based on a rate of temperature change after a peak temperature, such as immediately after time $t_0$ peak $t_p$, e.g., beginning at the first negative slope value on the mold body temperature over time curve, such as beginning at time $t_p$ in FIG. 6, such as from time $t_p$ to time $t_2$ in FIG. 6. The rate of temperature change after the peak temperature may be a rate of decrease in temperature of the mold body beginning at the peak temperature of the mold body.

Method 800 may further include a step 840 of determining an adjustment factor based on the estimated volume of the first fill of liquid water. For example, the adjustment factor may be determined based on an estimated thermal mass or an estimated volume of the liquid water, such as based on the estimated value compared to a predetermined target value, such as a predetermined target thermal mass or predetermined target volume, e.g., as described above with reference to FIG. 6.

In some embodiments, method 800 may include a step 850 of harvesting the ice piece from the mold body after forming the ice piece from the first fill. The step 850 of harvesting may thus complete a fill and harvest cycle of the ice maker appliance. In some embodiments, harvesting the ice piece from the mold body after forming the ice piece from the first fill at step 850 may include harvesting the ice piece at a harvest time. In such embodiments, the harvest time may be based on the estimated volume of the first fill of liquid water.

Exemplary methods such as method 800 may also include flowing a second fill of liquid water into the mold body after harvesting the ice piece, e.g., as illustrated at 860 in FIG. 8, such as step 860 may be a beginning of a second cycle, e.g., a subsequent or next fill and harvest cycle, of the ice maker appliance. In such embodiments, the second fill of liquid water may be based on the adjustment factor. For example, flowing the first fill of liquid water into the mold body may include opening a water valve for a first fill time, and flowing the second fill of liquid water into the mold body may include opening the water valve for a second fill time, and the second fill time may differ from the first fill time and may be based on the adjustment factor.

In some embodiments, estimating the volume of the first fill of liquid water may include a first estimate of the volume of the first fill of liquid water based on a rate of temperature change due to flowing the first fill of liquid water into the mold body (e.g., where flowing the first fill of liquid water into the mold body induces an increase in the mold body temperature up to a peak temperature) and a second estimate of the volume of the first fill of liquid water based on a rate of temperature change after the peak temperature. In such embodiments, the adjustment factor may be based on a weighted average of the first estimate and the second estimate.

In some embodiments, estimating the volume of the first fill of liquid water may include making an estimate of the volume of the first fill of liquid water based on a system constant. In such embodiments, the ice maker appliance may include a flow meter and may be a first ice maker appliance. Exemplary methods of operating the ice maker appliance further include transmitting, from the ice maker appliance to a second ice maker appliance, the system constant, e.g., where the second ice maker appliance does not include a flow meter. For example, the system constant may be transmitted from the flow meter ice maker appliance to the non-flow meter ice maker appliance via a remote database, e.g., as described above with reference to FIG. 7.

Figure 9:
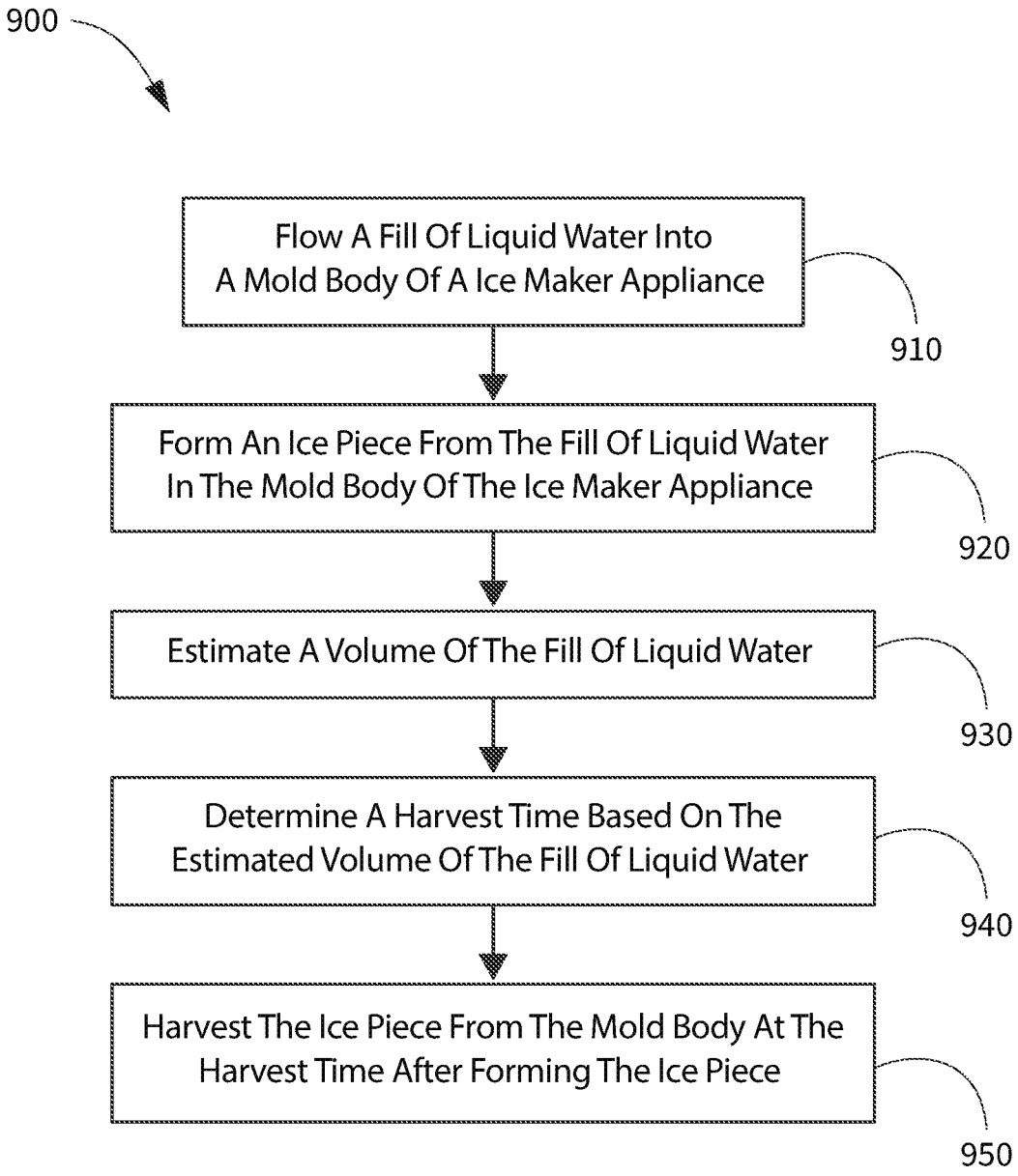
FIG. 9 provides another exemplary flow chart of a method of operating an ice maker appliance according to one or more additional exemplary embodiments of the present disclosure.

An exemplary method 900 of operating an ice maker appliance is illustrated in FIG. 9. As illustrated in FIG. 9, the method 900 may include a step 910 of flowing a fill of liquid water into a mold body of the ice maker appliance and may further include a step 920 of forming an ice piece from the fill of liquid water in the mold body of the ice maker appliance. Method 900 may further include a step 930 of estimating a volume of the fill of liquid water. In various embodiments, one or more of the foregoing steps of method 900, e.g., steps 910, 920, and/or 930 may include similar details and variations as described above with respect to method 800.

Method 900 may also include a step 940 of determining a harvest time based on the estimated volume of the fill of liquid water. For example, the harvest time may be a harvest count or may be determined by a harvest count, such as a harvest count which represents how long and how far a temperature, such as mold body temperature, is below the freezing point of water, e.g., such as the harvest count described above.

Method 900 may further include a step 950 of harvesting the ice piece from the mold body at the harvest time, e.g., when the harvest count reaches a harvest count threshold, after the step of forming. Method 900 may also include determining an adjustment factor based on the estimated volume of the fill of liquid water and flowing a second fill of liquid water into the mold body after harvesting the ice piece. In such embodiments, the second fill of liquid water may be based on the adjustment factor.

Referring now generally to FIGS. 8 and 9, the methods 800 and/or 900 may be interrelated and/or may have one or more steps from one of the methods 800 and 900 combined with the other method 800 or 900. Thus, those of ordinary skill in the art will recognize that the various steps of the exemplary methods described herein may be combined in various ways to arrive at additional embodiments within the scope of the present disclosure. For example, in method 800 may also include one or more of the exemplary steps described above with respect to method 900 or vice-versa.

Those of ordinary skill in the art will recognize that embodiments of the present disclosure may provide several advantages in the operation of ice maker appliances. For example, the present disclosure generally provides a smart ice maker appliance, e.g., where the ice maker is responsive to system conditions and other variables, such as by making adjustments in fill volume, harvest time, or other operating parameters of the ice maker appliance in response to measured and/or estimated conditions. Such smart ice maker appliances may provide an increased quantity of ice, such as by determining a harvest time based on the estimated volume of the fill of liquid water and harvesting the ice piece from the mold body at the harvest time, whereby the total time for the harvest and fill cycle is reduced, permitting a subsequent ice production cycle to begin sooner and thereby permitting the ice maker appliance to make ice faster and more efficiently. As another example, improved fill volumes may avoid or reduce instances of underfills or overfills. Underfills may result in poorly formed, e.g., misshapen or undersized, ice pieces, whereas overfills may result in poor ejection and separation of ice pieces. Accordingly, some embodiments of the present disclosure, e.g., embodiments which include determining an adjustment factor based on the estimated volume of the first fill of liquid water and flowing a second fill of liquid water into the mold body, wherein the second fill of liquid water is based on the adjustment factor, may advantageously provide better ice quality, e.g., more consistent size and shape of ice pieces and may avoid or reduce underfills and overfills. The foregoing advantages are provided by way of example only and without limitation. Those of ordinary skill in the art will recognize that some embodiments of the present disclosure may provide additional advantages as well as or instead of the exemplary advantages described herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating an ice maker appliance, the method comprising:

flowing a first fill of liquid water into a mold body of the ice maker appliance;

forming an ice piece from the first fill of liquid water in the mold body of the ice maker appliance;

estimating a volume of the first fill of liquid water, wherein estimating the volume of the first fill of liquid water comprises estimating the volume of the first fill of liquid water based on a rate of temperature change after a peak temperature;

determining an adjustment factor based on the estimated volume of the first fill of liquid water;

harvesting the ice piece from the mold body after forming the ice piece from the first fill; and flowing a second fill of liquid water into the mold body after harvesting the ice piece, wherein the second fill of liquid water is based on the adjustment factor.

2. The method of claim 1, wherein flowing the first fill of liquid water into the mold body comprises opening a water valve for a first fill time, and wherein flowing the second fill of liquid water into the mold body comprises opening the water valve for a second fill time, the second fill time based on the adjustment factor.

3. The method of claim 1, wherein estimating the volume of the first fill of liquid water comprises estimating the volume of the first fill of liquid water based on a rate of temperature change due to flowing the first fill of liquid water into the mold body.

4. The method of claim 3, wherein the rate of temperature change due to flowing the first fill of liquid water into the mold body is a rate of increase in temperature of the mold body induced by the first fill of liquid water.

5. The method of claim 1, wherein the rate of temperature change after the peak temperature is a rate of decrease in temperature of the mold body beginning at the peak temperature of the mold body.

6. The method of claim 1, wherein estimating the volume of the first fill of liquid water comprises a first estimate of the volume of the first fill of liquid water based on a rate of temperature change due to flowing the first fill of liquid water into the mold body and a second estimate of the volume of the first fill of liquid water based on the rate of temperature change after the peak temperature, wherein the adjustment factor is based on a weighted average of the first estimate and the second estimate.

7. The method of claim 1, wherein estimating the volume of the first fill of liquid water is based on a system constant and wherein the ice maker appliance includes a flow meter, further comprising transmitting, from the ice maker appliance to a second ice maker appliance, the system constant, wherein the second ice maker appliance does not include a flow meter.

8. The method of claim 1, wherein harvesting the ice piece from the mold body after forming the ice piece from the first fill comprises harvesting the ice piece at a harvest time, wherein the harvest time is based on the estimated volume of the first fill of liquid water.

9. A method of operating an ice maker appliance, the method comprising:

flowing a fill of liquid water into a mold body of the ice maker appliance;

forming an ice piece from the fill of liquid water in the mold body of the ice maker appliance;

estimating a volume of the fill of liquid water, wherein estimating the volume of the fill of liquid water comprises estimating the volume of the fill of liquid water based on a rate of temperature change after a peak temperature;

determining a harvest time based on the estimated volume of the fill of liquid water; and harvesting the ice piece from the mold body at the harvest time after the step of forming.

10. The method of claim 9, wherein estimating the volume of the fill of liquid water comprises estimating the volume of the fill of liquid water based on a rate of temperature change due to flowing the fill of liquid water into the mold body.

11. The method of claim 10, wherein the rate of temperature change due to flowing the fill of liquid water into the mold body is a rate of increase in temperature of the mold body induced by the fill of liquid water.

12. The method of claim 9, wherein the rate of temperature change after the peak temperature is a rate of decrease in temperature of the mold body beginning at the peak temperature of the mold body.

13. The method of claim 9, wherein estimating the volume of the fill of liquid water comprises a first estimate of the volume of the fill of liquid water based on a rate of temperature change due to flowing the fill of liquid water into the mold body and a second estimate of the volume of the fill of liquid water based on the rate of temperature change after the peak temperature, wherein the harvest time is based on a weighted average of the first estimate and the second estimate.

14. The method of claim 9, wherein estimating the volume of the fill of liquid water is based on a system constant and wherein the ice maker appliance includes a flow meter, further comprising transmitting, from the ice maker appliance to a second ice maker appliance, the system constant, wherein the second ice maker appliance does not include a flow meter.

15. The method of claim 9, further determining an adjustment factor based on the estimated volume of the fill of liquid water, and flowing a second fill of liquid water into the mold body after harvesting the ice piece, wherein the second fill of liquid water is based on the adjustment factor.

* * * * *